United States Patent [19]

Schröther

[11] 4,437,020

[45] Mar. 13, 1984

[54] ELECTROMAGNETIC SWITCHGEAR

[75] Inventor: Gerhard Schröther, Amberg, Fed. Rep. of Germany

[73] Assignee: Siemens Aktiengesellschaft, Munich, Fed. Rep. of Germany

[21] Appl. No.: 343,967

[22] Filed: Jan. 29, 1982

[30] Foreign Application Priority Data

Feb. 12, 1981 [DE] Fed. Rep. of Germany ..... 3105117

[51] Int. Cl.[3] ..... H01H 33/14

[52] U.S. Cl. ..... 307/135; 307/141.4; 307/154; 361/58; 200/243

[58] Field of Search ..... 307/112, 141.4, 98, 307/115, 135, 154; 361/15–17, 58; 200/243, 250

[56] References Cited

U.S. PATENT DOCUMENTS 3,339,161 8/1967 Conner et al. ..... 200/243
3,436,497 4/1969 Mading ..... 200/243
3,614,543 10/1971 Dick ..... 307/141.4
3,935,511 1/1976 Boulanger et al. ..... 361/58

FOREIGN PATENT DOCUMENTS 902400 2/1954 Fed. Rep. of Germany .

*Primary Examiner*—E. A. Goldberg
*Assistant Examiner*—Todd E. DeBoer
*Attorney, Agent, or Firm*—Kenyon & Kenyon

[57] ABSTRACT

An electromagnetic switchgear has a set of main and leading switches in a housing for adding series damping resistors to legs of a network which feeds a capacitive load. Plural switch sets are arranged side by side with associated main and leading switches positioned one over the other in two stories. Electrical bridges which extend over the two stories connect the input leads of the switches of a set. Similarly, a damping resistor is connected between the output leads of the switches of a set, and the resistors are mounted so that they lie, protected against external influences, between separation ribs on the switchgear housing.

5 Claims, 3 Drawing Figures

ELECTROMAGNETIC SWITCHGEAR

BACKGROUND OF THE INVENTION

This invention relates to electromagnetic switchgear in which leading contacts are used to temporarily insert a damping resistor in series with a capacitive load and in which main contacts are subsequently closed to carry the steady-state load current.

In one electromagnetic switch of the above-mentioned general type (German Patent No. 902,400), a particular switch design is provided which is used with a separately supported series resistor. This arrangement requires a substantial amount of space.

In contactors for three-phase capacitors, it is also known to screw fast-discharge resistors onto a plate which supports the auxiliary contactor or to connect them directly to the terminals of the auxiliary contactor. The fast-discharge resistors are arranged parallel to the mounting plane of the contactor, so that again a relatively substantial space is required for the overall combination, and the desired connection of the damping series resistors during the closing of the contactor by means of leading contacts is not achieved.

It is an object of the present invention to construct switchgear of the type described above in such a way that, when using damping series resistors with switchgear which is designed for quantity production, a compact unit is obtained.

SUMMARY OF THE INVENTION

The problem is solved in a switchgear in which a set of main and the leading switches for a particular network connection are disposed one above the other in two stories. An electrical jumper is connected to the input contacts of each switch and extends the height of both stories. The output contacts of the switches are bridged by a resistor. Compactness of the unit and safety from shock without the need of special covers are enhanced by installing the damping resistors, which are wound of insulated wire, at least partially between separation ribs on phase walls which form part of the housing. This also provides increased safety against breakage. Also a higher value of $I^2t$ value results when the same resistance value and the same resistor dimensions are used.

DETAILED DESCRIPTION OF THE INVENTION

Figure 1:
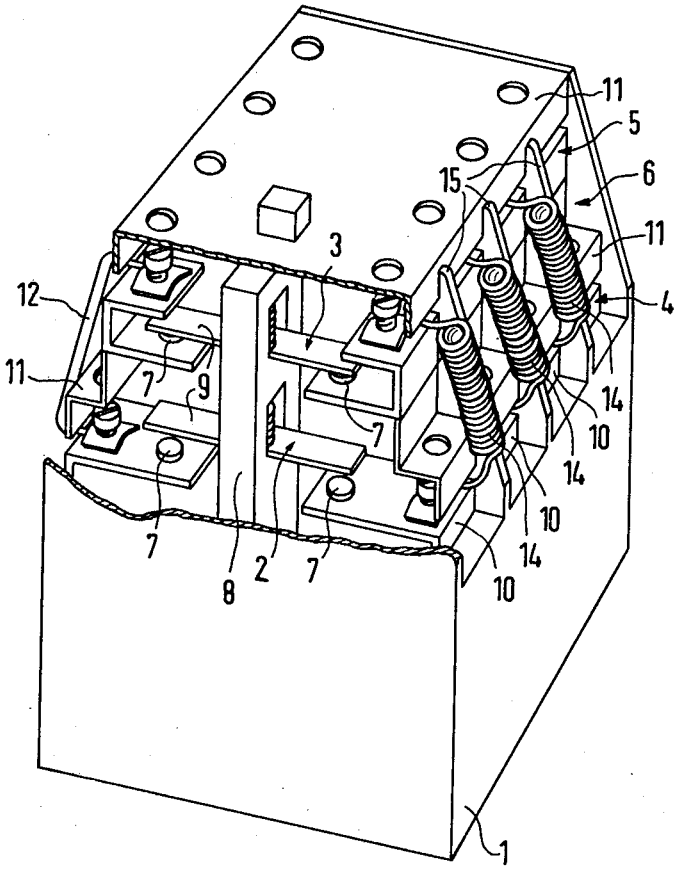
FIG. 1 is a perspective view of a switchgear fabricated according to the teachings of the invention.

The switchgear shown in FIG. 1 has housing 1, in which main switches 2 and leading switches 3 are arranged, one above the other, in two stories 4 and 5, being also above an electromagnetic actuator (not shown). The switchgear has three pole tracks, each having a set of switches consisting of a main switch 2 and a leading switch 3. When the switchgear is actuated, each leading switch 3 closes before each main switch 2. A fourth track 6 is equipped with a normal break switch in story 4 and a make switch in story 5. Each switch has stationary input and output contacts 7 which are closed by a contact bridge 9. Bridge 9 is held in a known manner and can be moved vertically by movable contact bridge holder 8. Contact bridge holder 8 is actuated by the magnetic drive which was referred to above. The stationary contact parts 7 are equipped with terminals 10 which are protected from outside contact by plastic covers 11. Jumpers (electrical bridges) 12 are provided on the input lead side of main switches 2 and leading switches 3, being inserted under a contact element forming part of each respective terminal. In the illustrative embodiment, the jumpers take the form of wire pieces which are stripped of insulation where they enter each terminal. Connecting leads 13 of the network (see FIG. 2) are clamped in the same way to either main switch 2 or leading switch 3. Resistors 14 are clamped on the output sides of main and leading switches 2 and 3, respectively, each having its ends fastened to a respective main or leading contact. In the illustrative embodiment, resistors 14 are realized as wire coils, and each resistor is at least partially separated from its neighbor by a rib 15 on a phase wall forming part of housing 1 so that they are protected against external influences. Because the switchgear is tapered toward the top, practically no additional space is required to accommodate the resistors.

Figure 2:
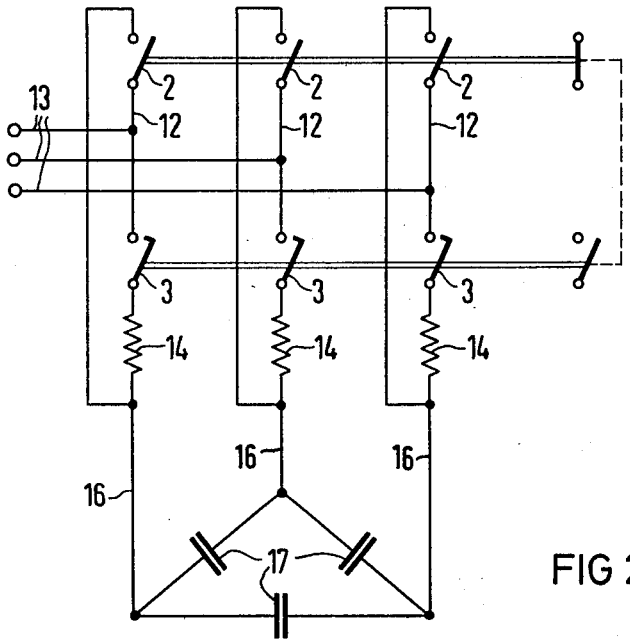
FIG. 2 is a schematic diagram showing how the switchgear is connected to the capacitors.

The overall circuit showing interconnection of resistors, bridges and contacts may be seen in FIG. 2. One network connecting lead 13 is connected to each jumper 12 and thus with an associated main switch 2 and leading switch 3. The output terminals of main switch 2 and leading switch 3, respectively, are each inter-connected via a resistor 14 and electrically connected to a lead 16 which, in turn, is connected to a junction point of delta-connected capacitive load (shown as capacitors) 17. In operation, this circuit first connects capacitors 17 to the network via series resistors 14 and leading switches 3. Then, when switches 2 close afterwards, series resistors 14 and leading switches 3 are short-circuited. When capacitors 17 are to be disconnected, the procedure is reversed so that switching-off damping is also provided; e.g. leading switches 3 open after main switches 2 have been opened.

Figure 3:
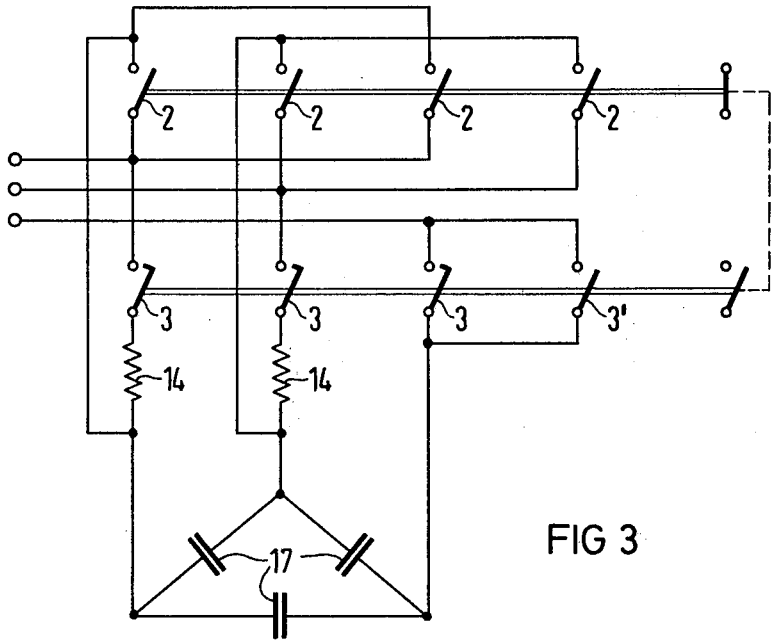
FIG. 3 shows the circuit of an electromagnetic switchgear designed in accordance with the teachings of the invention, having three pole tracks and two series resistors, wherein particular switches are connected in parallel to increase the steady-state current-carrying capacity and wherein a pair of auxiliary make and break contacts are provided.

In the circuit of FIG. 3, only two resistors 14 are required. Differing from the embodiment of FIG. 2, two pairs of parallel-connected main contacts 2 are each associated with a resistor 14. The third phase is connected via the contacts of parallel-connected leading switch 3 and normal make switch 3' to the third network lead 13. The two story contactor drive used here therefore has five pole tracks. The fifth pole track carries make and break switches which serve for supervisory and control purposes. Connecting the switches in parallel serves to increase the steady-state current-carrying capacity.

What is claimed is:

1. An electromagnetic switchgear, useful for making and breaking at least one connection from a network to a capacitive load via a damping resistor, comprising:

a set of switches for each connection being switched, each set comprising a main switch and a leading switch disposed one above the other in stories in the switchgear and operable together, each switch comprising an input contact adapted to be connected to the network, an output contact adapted to be connected to the capacitive load, and a movable bridge contact;

a jumper electrically coupling the input contacts of each set, the jumper extending from one story to the other; and a resistor coupling the output contacts of each set, the resistor extending from one story to the other.

2. An electromagnetic switchgear in accordance with claim 1 in which the network has a plurality of phases and in which the resistors are wound of insulated wire, and further comprising:

a housing in which the switchgear is mounted, the housing comprising phase walls with separation ribs, each resistor being at least partially separated from external influence by at least one separation rib.

3. An electromagnetic switchgear in accordance with claim 1 in which the network has three phases and in which damping resistors are connected between the output contacts of only two sets of switches.

4. An electromagnetic switchgear in accordance with claim 1 in which the network has at least two connecting leads and further comprising:

a second switch connected in parallel with each switch in a set which carries steady state current, the second switch operated at the same time as the switch with which it is in parallel.

5. In an electromagnetic switchgear, useful for making and breaking at least one connection from a network to a capacitive load, comprising:

a set of switches for each connection being switched, each set comprising a main switch and a leading switch, each switch comprising an input contact adapted to be connected to the network, an output contact adapted to be connected to the capacitive load, and a movable bridge contact;

means to move the bridge contacts of said main and leading switches such that, on closing, said leading switch closes before said main switch and on opening said main switch opens before said lead switch;

a jumper electrically coupling the input contacts of each set; and a resistor coupling the output contact of said lead switch to the capacitive load, the improvement comprising:

(a) the lead and main switches disposed one above the other in the switchgear forming two stories with said input and output contacts on opposite sides of the switchgear;

(b) said jumper extending between the input contacts on one side; and (c) said resistor extending between the output contacts on the other side.

* * * * *